US006371775B1

(12) United States Patent
Nakatsuka

(10) Patent No.: US 6,371,775 B1
(45) Date of Patent: Apr. 16, 2002

(54) FASTENING CAP

(75) Inventor: Yoshiaki Nakatsuka, Nara (JP)

(73) Assignee: Seiwa Kogyo Kabushiki Kaisha, Osaka (JP)

( * ) Notice: Subject to any disclaimer, the term of this patent is extended or adjusted under 35 U.S.C. 154(b) by 0 days.

(21) Appl. No.: 09/706,409

(22) Filed: Nov. 3, 2000

(51) Int. Cl.[7] ..... H01R 13/44
(52) U.S. Cl. ..... 439/127; 439/345
(58) Field of Search ..... 439/127, 125, 439/126, 128, 130, 345, 502, 34

(56) References Cited

U.S. PATENT DOCUMENTS 5,188,537 A * 2/1993 Itoh et al. ..... 439/127
5,221,213 A * 6/1993 Lee ..... 439/125
5,630,721 A 5/1997 Nakatsuka

* cited by examiner

*Primary Examiner*—Brian Sircus
*Assistant Examiner*—Brian S. Webb
(74) *Attorney, Agent, or Firm*—Koda & Androlia

(57) ABSTRACT

A synthetic resin fastening cap which allows a connecting cap at the end of a plug cord to move in a broad angle range on the wiring terminal of a distributor of an automobile. The fastening cap is provided with a cord lead-out opening by cutting away approximately one-half of the skirt portion of the fastening cap in the circumferential direction so that the plug cord is led out of the fastening cap. The head portion of the fastening cap has a predetermined thickness so that a recess that is set at the same dimension as the height of a projection of the connecting cap is formed in the head portion and the projection of the connecting cap is inserted in this recess for preventing the connecting cap from slipping out of the fastening cap.

3 Claims, 5 Drawing Sheets

Fig. 2
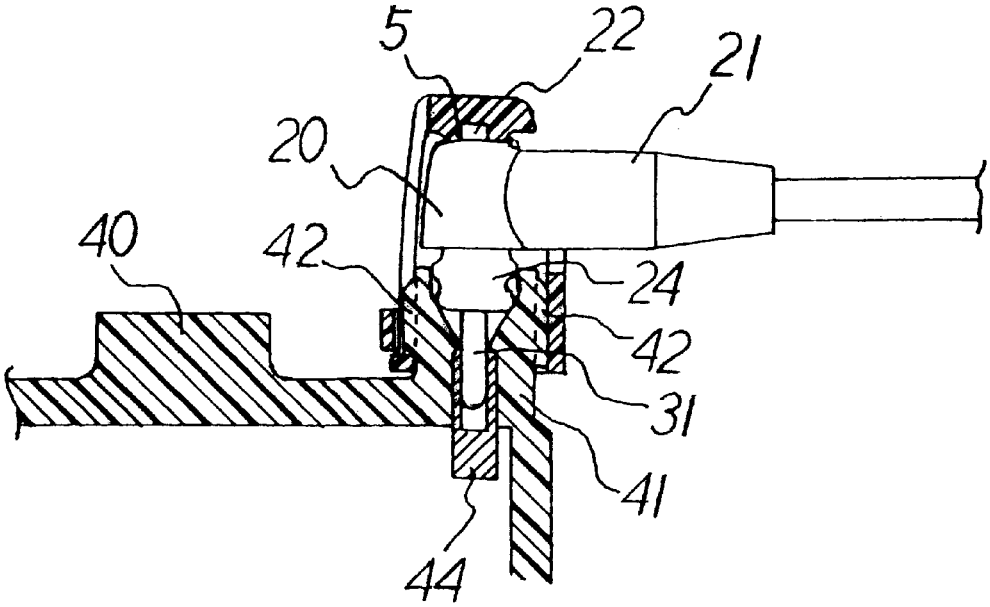
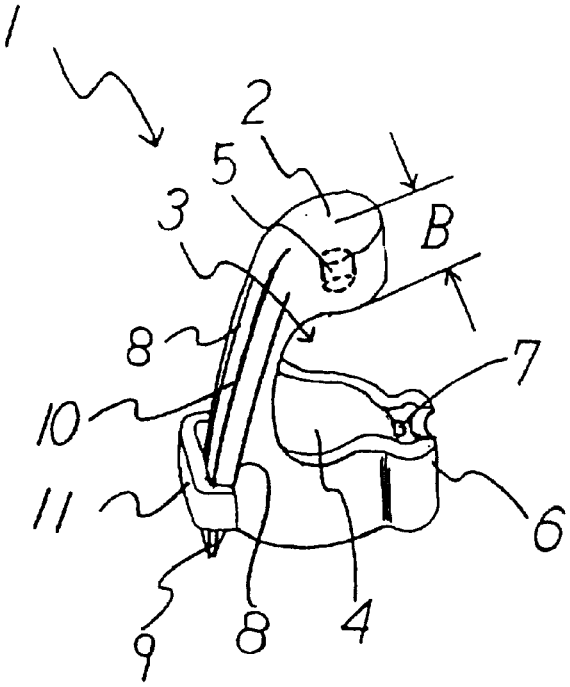
Fig. 3

FASTENING CAP

BACKGROUND OF THE INVENTION

1. Field of the Invention

The present invention relates to a fastening cap for fastening a plug cord to a wiring terminal inside the engine compartment of an automobile and the like.

2. Prior Art

In engines of automobiles, etc., the distributor and spark plugs are connected by way of connecting plug cords to a plurality of wiring terminals of the distributor cap. When connecting caps are attached to the plug cord terminals and these connecting caps are fastened to the wiring terminals of such a distributor cap, this fastening is ordinarily accomplished by fastening caps that are provided as original parts. FIGS. 7 and 8 show one type of a fastening cap provided as an original part. FIG. 7 is a perspective view of the fastening cap, and FIG. 8 is its bottom view.

As seen from FIGS. 7 and 8, this fastening cap 50 is formed substantially in the shape of a conical tube so that a connecting cap that is at the end of the plug cord can be engaged with the inside thereof. The fastening cap 50 is comprised of a head portion 51 and a skirt portion 52. The skirt portion 52 continuously extends from the lower end of the head portion 51. An engaging opening 53 and an engaging groove 54 which are detachably engaged with engaging protrusions of the tubular wall of a wiring terminal are formed in the skirt portion 52 of the fastening cap 50. The skirt portion 52 of the fasting cap 50 is further provided with a cord lead-out opening 55 which allows the plug cord to be led out from the circumferential surface of the fastening cap 50.

The cord lead-out opening 55 is formed by cutting out a part of the skirt portion 52 so that the opening 55 matches the external diameter of the plug cord. A recess 56 is formed in the head portion 51 of the fastening cap 50. The recess 56 accommodates the projection formed on the head portion of the connecting cap.

Generally, in fastening caps provided as original parts, the cord lead-out opening is formed so as to match the external diameter of the plug cord. As a result, the movement of the connecting cap is restricted; and in cases where the plug cord is to be led out in desired direction, it is necessary to prepare a new fastening cap that has the engaging opening and engaging groove altered in position in accordance with direction in which the cord is led out of the fastening cap. As a result, a new mold is required for manufacturing such a new fastening cap, and this increases the manufacturing cost of the fastening caps.

SUMMARY OF THE INVENTION

Accordingly, the inventors conducted a diligent research for a fastening cap for repair use that is inexpensive and has all-purpose utilities. The inventors discovered that with a cord lead-out opening formed by cutting away approximately one-half of the skirt portion in the circumferential direction, cord lead-out can be handled over a broad angular range (as large as 180°) and the all-purpose utilities of the fastening cap are improved, and this can be done without altering the positions of the engaging opening and engaging groove of the fastening cap. Furthermore, the head portion of the fastening cap is formed so as to have a certain predetermined thickness, and a recess, into which the projection of the head portion of the connecting cap is inserted, is formed in the head portion of the fastening cap that has such a thickness, and the depth of this recess is set to be the same dimension as the height of the projection. With this structure of the fastening cap, it is possible to remove the connecting cap easily.

There are no particular restrictions on the material of the fastening cap. By forming the fastening cap integrally in a single body from synthetic resin, the fastening cap can be easily and inexpensively manufactured. In forming the fastening cap, an injection molding is most preferably used.

BRIEF DESCRIPTION OF THE DRAWINGS

FIG. 2 is a sectional view showing the use of the fastening cap;

FIG. 3 is a perspective view of the fastening cap;

DETAILED DESCRIPTION OF THE PREFERRED EMBODIMENTS

Preferred embodiments of the present invention will be described below with reference to the accompanying drawings.

Figure 1:
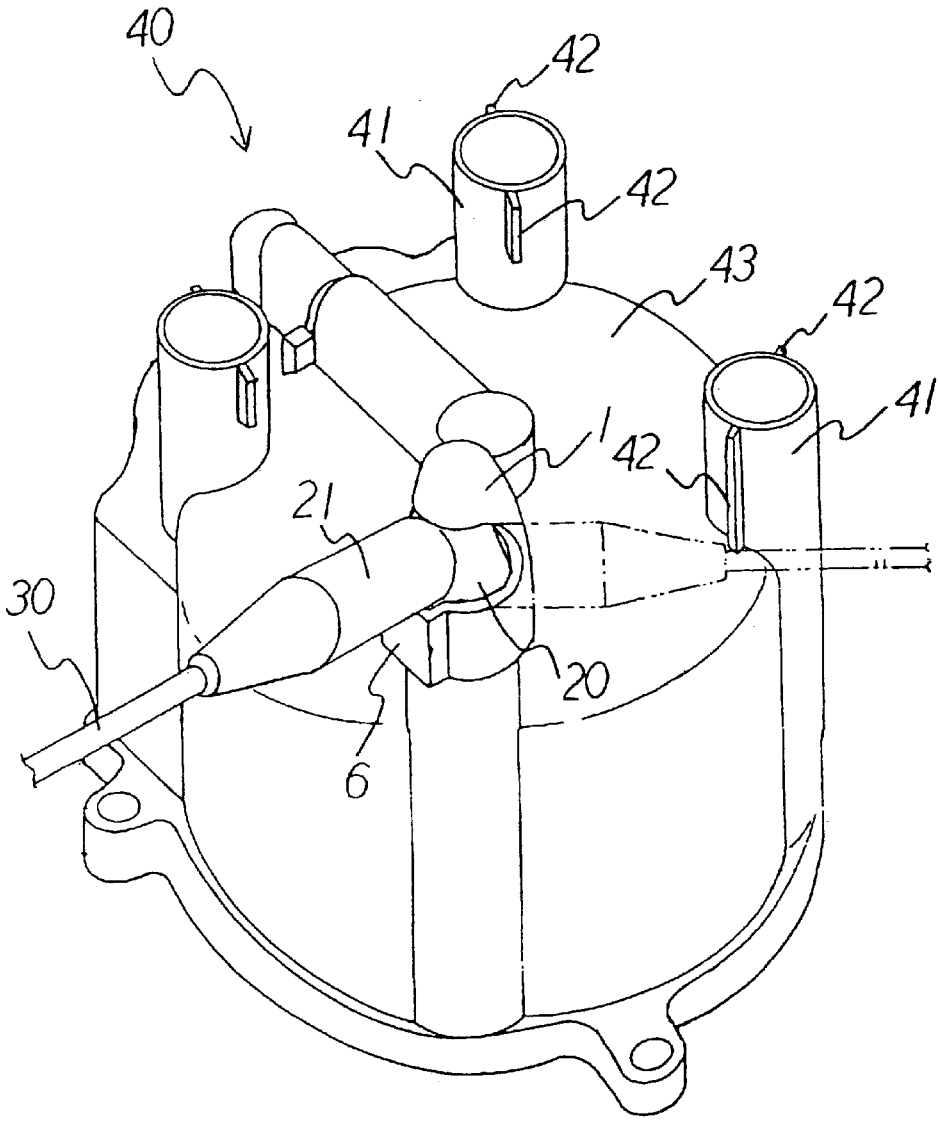
FIG. 1 is a perspective view showing the manner of use of the fastening cap according to the present invention.

FIG. 1 shows a fastening cap 1 that detachably fastens a connecting cap 20 attached to the tip end of a plug cord 30 to the wiring terminal 41 of a distributor cap 40. The fastening cap 1 is fastened in place by being fitted over the outside of the tubular wall of the wiring terminal 41.

A plurality of wiring terminals 41 protrude from the top surface 43 of the distributor cap 40, which covers a distributor (not shown) of an engine of, for instance, an automobile. Pair of engaging protrusions 42 that make an engagement with and fasten to the fastening cap 1 are formed on the outsides of the tubular walls of the respective wiring terminals 41.

As seen from FIG. 2, a connecting cap 20 that protects the connection part between terminal 31 and plug cord 30 is attached to the corresponding wiring terminal 41. The external shape of the connecting cap 20 is substantially conical. The connecting cap 20 is provided with a terminal holder 24 and a cord portion 21 that are integrally molded. The terminal holder 24 protects a part of the terminal 31 and is attached so that it can be held on the inside wall of the wiring terminal 41 by elastic deformation. The cord portion 21 is led out from the circumferential surface of the connecting cap 20. A projection 22 that prevents the connecting cap 20 from slipping out of the fastening cap 1 is formed on the head portion of the connecting cap 20. The connecting cap 20 is made of a synthetic rubber that has electrical insulating properties and waterproof properties.

When fastened in place by the fastening cap 1, the projection 22 of the connecting cap 20 prevents the connecting cap 20 from slipping out of the fastening cap 1. The fastening cap 1 is fastened in place by being engaged with the engaging protrusions 42 of the wiring terminal 41. The order of attachment is as follows: the connecting cap 20 and fastening cap 1 are assembled into an integral unit, and then these elements are attached to the wiring terminal 41.

The structure of the fastening cap 1 will be described below next with reference to FIGS. 3 through 5.

The fastening cap 1 is used as a replacement for the original part or as a repair part. The fastening cap 1 is integrally molded from a synthetic resin and is formed in substantially a conical shape so that the connecting cap 20 is engaged inside. The fastening cap 1 is comprised of a head portion 2 and a skirt portion 3. The head portion 2 holds the projection of the connecting cap 20 and prevents the connecting cap 20 from slipping out. The skirt portion 3 is formed continuous from the lower end of the head portion 2.

The skirt portion 3 is formed with a cord lead-out opening 4. The cord lead-out opening 4 is located in roughly the middle portion of the skirt portion 3 (with respect to the vertical direction) so that the cord portion 21 can be led out of the fastening cap 1. This cord lead-out opening 4 is formed by cutting away approximately one-half of the skirt portion in its circumferential direction, so that the direction in which the cord portion 21 is led out can be selected from approximately 180° ranges.

In the portion of the skirt portion 3 that is located beneath the cord lead-out opening 4, a thick protruding portion 6 is formed. The protruding portion 6 protrudes in the radial direction of the conical fastening cap 1, and it is provided at an intermediate position in the circumferential direction in which the cord lead-out opening 4 is formed. An engaging groove 7 which engages with one of the engaging protrusion 42 of the wiring terminal 41 is formed in the longitudinal direction in the inside wall of this protruding portion 6 so that the engaging groove 7 communicates with the cord lead-out opening 4.

Furthermore, in order to facilitate the insertion of the connecting cap 20 through the cord lead-out opening 4, the protruding portion 6 is cut away into a semicircular shape. The semicircular cutout is set to be smaller, in size, than the external diameter of the cord portion 21 so that the cord portion 21 can be supported thereby.

Figure 4:
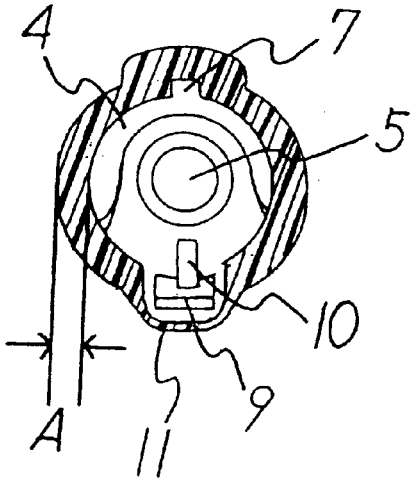
FIG. 4 is a bottom view thereof.
Figure 5:
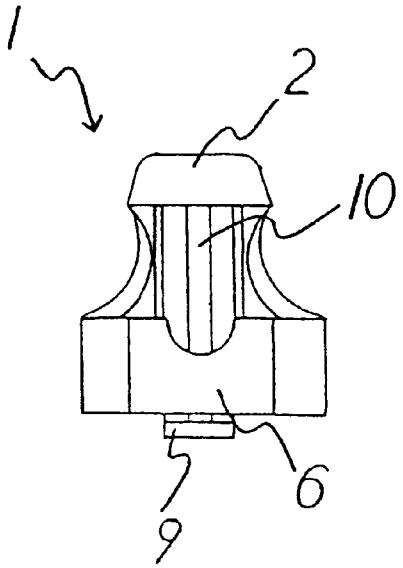
FIG. 5 is a front view thereof.
Figure 8:
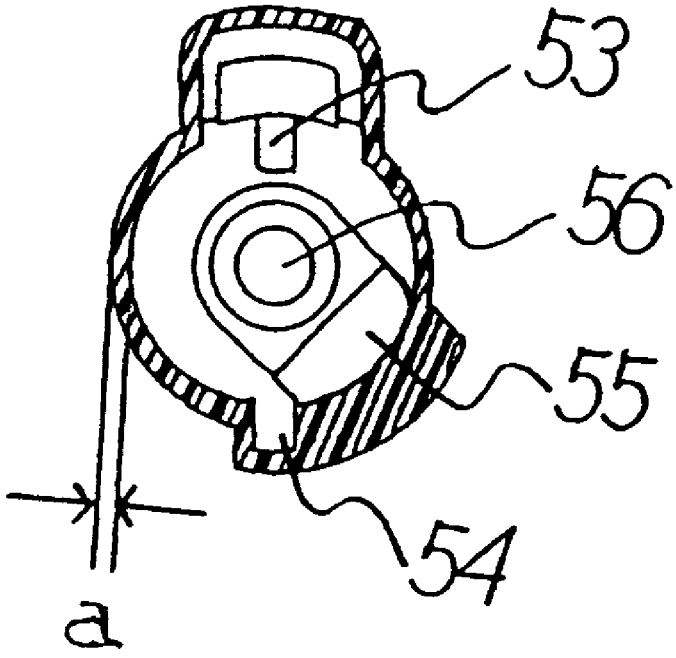
Fig. 8 PRIOR ART
FIG. 8 is a bottom view thereof.

As shown in FIG. 4, the skirt portion 3 is formed thicker (A) than that of the original part 50 (the thickness of the skirt portion of the original part 50 being indicated by "a" in FIG. 8). As a result, even in case where the cord lead-out opening 4 is formed large, the strength of the fastening cap 1 is sufficiently maintained.

Figure 6:
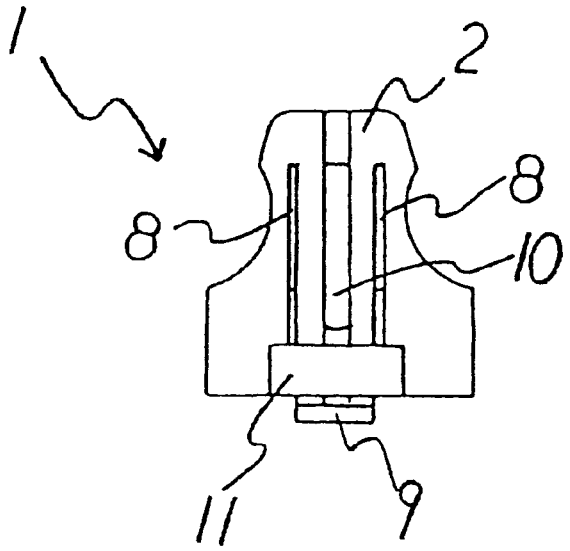
FIG. 6 is a rear view thereof.

As seen from FIG. 6 that is a rear view of the fastening cap 1, an engaging opening 10 is formed in the circumferential surface of the skirt portion 3. The engaging opening 10 is located on the opposite side from the cord lead-out opening 4, and it engages with another one of the engaging protrusions 42 of the wiring terminal 41. The engaging opening 10 is obtained by making two cuts 8 in the circumferential surface of the skirt portion 3.

More specifically, the two cuts 8 are made to run parallel in the vertical direction from the head portion 2 to the lower end of the skirt portion 3 so as to form an elastic pawl 9 that possesses elasticity, and further the central portion of this elastic pawl 9 is cut out in the direction of the length of the pawl 9, so that this cut-out intermediate portion makes the engaging opening 10.

Figure 7:
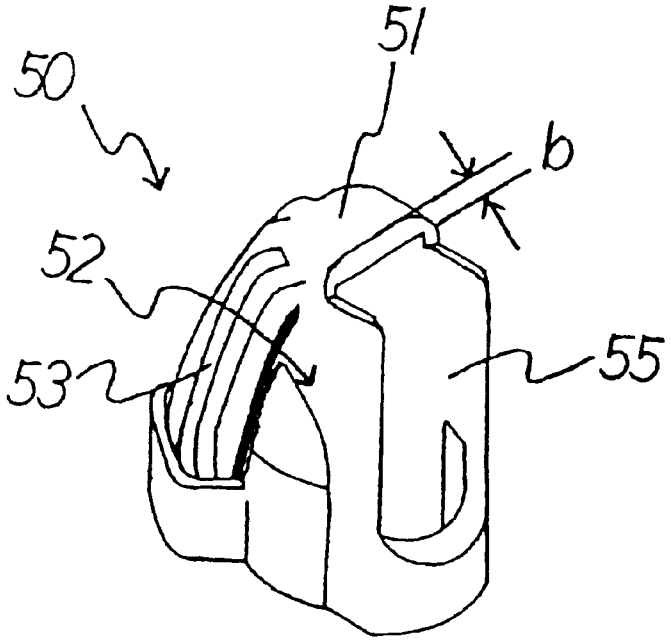
Fig. 7 PRIOR ART
FIG. 7 is a perspective view of a fastening cap provided as an original part.

The elastic pawl 9 and the engaging opening 10 are set so that they are slightly longer than the length of the skirt portion 3 in the vertical direction. Furthermore, a stopper 11 is formed so as to protrude from the skirt portion 3. The stopper 11 arches over the elastic pawl 9. The stopper 11 restricts the swing motion of the elastic pawl 9 that is toward the outside and is due to the elasticity of the pawl 9. The structure and shape of each of the elastic pawl 9, engaging opening 10 and stopper 11 is the same as that of the original part shown in FIGS. 7 and 8.

As shown in FIG. 3, the thickness B of the head portion 2 of the fastening cap 1 is greater than the thickness b of the head portion 51 (see FIG. 7) of the original part. The head portion 2 that has this thickness B is provided with a recess 5 into which the projection 22 of the head portion of the connecting cap 1 is inserted. So as to prevent the connecting cap 20 from slipping out of the fastening cap 1, the depth of the recess 5 is set to be substantially the same as the height of the project ion 22 of the connecting cap 20.

The connecting cap 20 fastened to the wiring terminal 41 by the fastening cap 1 will be described below in detail with reference to FIG. 2.

A segment 44 is formed in the bottom portion of each wiring terminal 41 of the distributor cap 40. The terminal 31 of the plug cord 30 is inserted into this segment 44 so that high voltage generated by, for instance, the ignition coil (not shown) is led to the distributor (not shown). When the terminal 31 of the plug cord 30 is inserted into the segment 44, the terminal holder 24 undergoes elastic deformation; and the terminal holder 24 is held in place by the inside wall surface of the wiring terminal 41.

The fastening cap 1 is assembled into an integral unit with the connecting cap 20 therein in advance. Then, the terminal 31 and the terminal holder 24 are fastened to the inside of the wiring terminal 41, and the fastening cap 1 is fitted over the outside of the tubular wall of the wiring terminal 41. Furthermore, the engaging opening 10 of the fastening cap 1 is engaged with the lower end of one of the engaging protrusions 42 of the wiring terminal 41, so that the fastening cap 1 is prevented from slipping out of the wiring terminal 41. In this case, the projection 22 of the head portion of the connecting cap 20 is inside the recess 5 of the fastening cap 1, so that the connecting cap 20 is prevented from slipping out of the fastening cap 1.

In the above structure, the cord lead-out opening 4 is formed by cutting away approximately one-half of the skirt portion 3 in the circumferential direction in the fastening cap 1. Accordingly, as indicated by the solid lines and two-dot chain lines in FIG. 1, the cord 30 connected to the connecting cap 20 can horizontally pivot through a broad angle on the wiring terminal 41. There is, thus, no need to prepare a fastening cap that is specially made to match the cord lead-out direction, and the mold used to manufacture the fastening cap can be used in common for different fastening caps. As a result, manufacturing costs and storage costs can be greatly reduced, and the fastening cap can be used for repairs.

Since about one-half of the skirt portion 3 is cut away in the circumferential direction, the cord portion 21 can pivot approximately 180°. In addition, since the cord lead-out opening 4 is wide, the assembling of the fastening cap 1 and connecting cap 20 into a single unit is greatly facilitated.

What is claimed is:

1. A fastening cap for fastening a connecting cap attached to an end of a plug cord to a wiring terminal, wherein said fastening cap has substantially a conical tube shape and is comprised of a head portion and a skirt portion that continuously extends from a lower end of said head portion, so that said connecting cap engages with inside of said fastening cap, said skirt portion is provided with an engaging opening and an engaging groove which detachably engage with engaging protrusions formed on said wiring terminal, and a cord lead-out opening is provided in said skirt portion which allows a lead-out of said plug cord led out from a circumferential surface of said connecting cap; and wherein said fastening cap is integrally formed from a synthetic resin, said skirt portion is thick, and said cord lead-out opening is formed by cutting away approximately one-half of said skirt portion in a circumferential direction thereof.

2. The fastening cap according to claim 1, wherein said head portion of said fastening cap has a predetermined thickness, a recess into which a projection of a head portion of said connecting cap is inserted so that said projection is prevented from slipping out is formed in said head portion of said fastening cap, and a depth of said recess is set to be substantially the same as a height of said projection of said connecting cap.

3. A fastening cap for covering a connecting cap attached to an end of a plug cord and fastening said connecting cap to a wiring terminal of a distributor cap, said fastening cap being substantially in a conical tube shape and comprised of a head portion and a skirt portion that continuously extends from said head portion, wherein a cord lead-out opening is provided in said skirt portion which is formed by cutting away at least one-half of said skirt portion in a circumferential direction thereof so as to be larger in size than a diameter of said plug cord thus allowing said plug cord to pivot in a circumferential direction of said fastening cap, said fastening cap is integrally formed from a synthetic resin and said skirt portion is thick.

* * * * *